US006904775B2

(12) United States Patent
Makos et al.

(10) Patent No.: US 6,904,775 B2
(45) Date of Patent: Jun. 14, 2005

(54) CUFF LOCK AND PUSH-BUTTON LOCKING MECHANISM

(75) Inventors: Timothy Makos, Brookfield, WI (US); Joseph Elliott, Mequon, WI (US); Kenneth N. Grandy, Sr., South Milwaukee, WI (US); Victor Yip, Chi Fu Pa Yeun (HK)

(73) Assignee: Master Lock Company, OakCreek, WI (US)

( * ) Notice: Subject to any disclaimer, the term of this patent is extended or adjusted under 35 U.S.C. 154(b) by 0 days.

(21) Appl. No.: 10/249,013

(22) Filed: Mar. 11, 2003

(65) Prior Publication Data

US 2004/0016268 A1 Jan. 29, 2004

Related U.S. Application Data

(62) Division of application No. 10/038,095, filed on Jan. 4, 2002, now abandoned.
(60) Provisional application No. 60/259,966, filed on Jan. 4, 2001.

(51) Int. Cl.[7] ..... E05B 75/00
(52) U.S. Cl. ..... 70/16; 70/386; 70/491; 70/404
(58) Field of Search ..... 70/345, 351, 360, 70/386, 387, 491, 404, 496, 16; 292/DIG. 37

(56) References Cited

U.S. PATENT DOCUMENTS

| | | | | | |
|---|---|---|---|---|---|
| 2,687,032 | A | * | 8/1954 | Craig | 70/285 |
| 3,420,077 | A | * | 1/1969 | Drazin | 70/276 |
| 3,509,748 | A | * | 5/1970 | Trainor | 70/491 |
| 4,012,931 | A | * | 3/1977 | Harunari | 70/496 |
| 4,069,696 | A | * | 1/1978 | Steinbach | 70/491 |
| 4,180,996 | A | * | 1/1980 | Lebrecht | 70/52 |
| 5,133,203 | A | * | 7/1992 | Huang | 70/360 |
| 5,447,049 | A | * | 9/1995 | Shieh | 70/360 |
| 5,720,191 | A | * | 2/1998 | Tsung-Chuan et al. | 70/38 A |
| 5,921,118 | A | * | 7/1999 | Yuan | 70/201 |
| 6,463,774 | B2 | * | 10/2002 | Sokurenko | 70/360 |
| 6,564,602 | B2 | * | 5/2003 | Gregory | 70/360 |
| 6,644,078 | B1 | * | 11/2003 | Hung | 70/491 |
| 6,782,725 | B2 | * | 8/2004 | Linares | 70/360 |

FOREIGN PATENT DOCUMENTS

| | | |
|---|---|---|
| JP | 214843 | 10/1993 |
| JP | 297445 | 2/1997 |
| JP | 320204 | 11/1997 |

* cited by examiner

*Primary Examiner*—John B. Walsh
(74) *Attorney, Agent, or Firm*—Calfee, Halter & Griswold, LLP

(57) ABSTRACT

The invention provides a pair of cuff locks joined by a universal joint and linkage system which provides for 360 relative rotation between the cuffs as well as allow the cuffs to be folded together into a compact position. The invention further provides for a push button cylinder lock which includes a rotatable plug and a fixed plug each having a plurality of aligned bores for receiving one or more tumbler pins. The push button cylinder lock further includes a non-rotatable push button shaft which is sildably mounted within the housing. One or more retaining pins engage locking indents of the push button shaft.

19 Claims, 8 Drawing Sheets

CUFF LOCK AND PUSH-BUTTON LOCKING MECHANISM

CROSS REFERENCE TO RELATED APPLICATIONS

This application is a divisional of commonly owned application Ser. No. 10/038,095 filed Jan. 4, 2002, now abandoned which claims the benefit of U.S. Provisional Application No. 60/259,966, filed on Jan. 4, 2001.

BACKGROUND OF INVENTION

The invention provides an improved design for securing personal objects such as a bicycle or other personal objects such as a portable computer. Prior art bicycle locks typically are made of metal and generally have a large inflexible U shape which are bulky in size. Further, prior art bicycle locks generally require a key to both lock and unlock the lock. Another disadvantage to prior art bicycle locks is that they require two hands to operate the lock. Yet another disadvantage to prior art bicycle locks is that they are not adjustable in size to accommodate the object to be secured. Thus an improved bicycle lock is desired which overcomes the above described disadvantages.

The invention further provides an improved design for a push button cylinder lock. Prior art cylinder locks are typically susceptible to attack by saws, and by rapping or banging the lock with an object in order to unseat the pins. A further disadvantage to prior art cylinder locks is that the locking bar rotates. This rotation makes it more difficult to interface with a secondary component. Thus an improved push button cylinder lock is desired which overcomes the above described disadvantages.

SUMMARY OF INVENTION

The invention provides in one aspect a cuff lock for securing personal objects such as a bicycle to a fixture. The cuff lock comprises a first and second cuff, with each of the first and second cuffs including a stationary arm mounted upon a housing, and a swing arm pivotally connected to said stationary arm and having a ratcheted end. Each of the housings further include a bore for receiving the ratcheted end of the swing arm. Each of the housings also include a spring mounted locking lever having a first end for engaging the ratcheted end of the swing arm. The spring mounted locking lever further includes a shoulder for engaging a shaft of a lock cylinder.

The invention provides in a second aspect a cylinder lock comprising a housing having a rotatable plug rotatably disposed therein and a fixed plug secured to said housing. The non-rotatable shaft is slidably mounted within the housing and is slidable between a locked position and an unlocked position. The non-rotatable shaft includes an actuated end extending from an end of said housing and a latching end extending from an opposite end of said housing. One or more tumbler pins are received in one or more axially aligned bores of the fixed plug and the rotatable plug; and one or more retaining elements are positioned for engagement with the non-rotatable shaft.

The invention provides in yet another aspect a cylinder lock comprising: a housing having a rotatable plug rotatably disposed therein and a fixed plug secured to said housing. A non-rotatable shaft is slidably mounted within the housing and is slidable between a locked position and an unlocked position. The non-rotatable shaft includes an actuated end extending from an end of said housing and a latching end extending from an opposite end of said housing. One or more retaining elements are positioned for engagement with a groove of said non-rotatable shaft.

These and other features and advantages of the invention will become apparent in the detailed description and claims to follow, taken in conjunction with the accompanying drawings.

DETAILED DESCRIPTION

Figure 1:
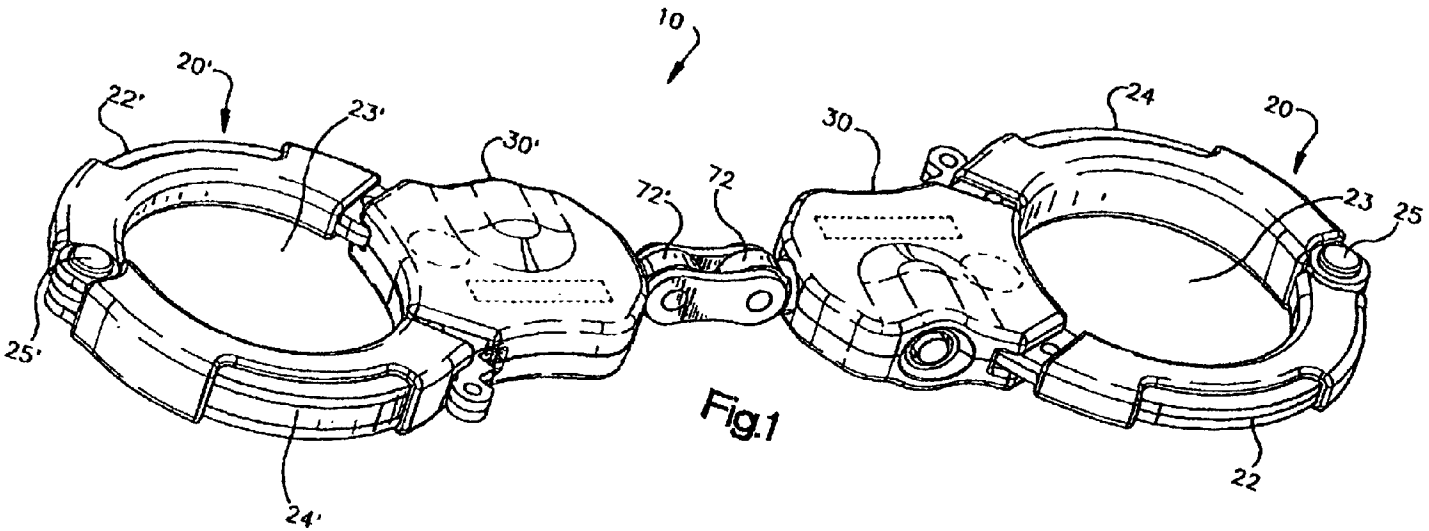
FIG. 1 is a perspective front view of the cuff lock of the present invention.
Figure 2:
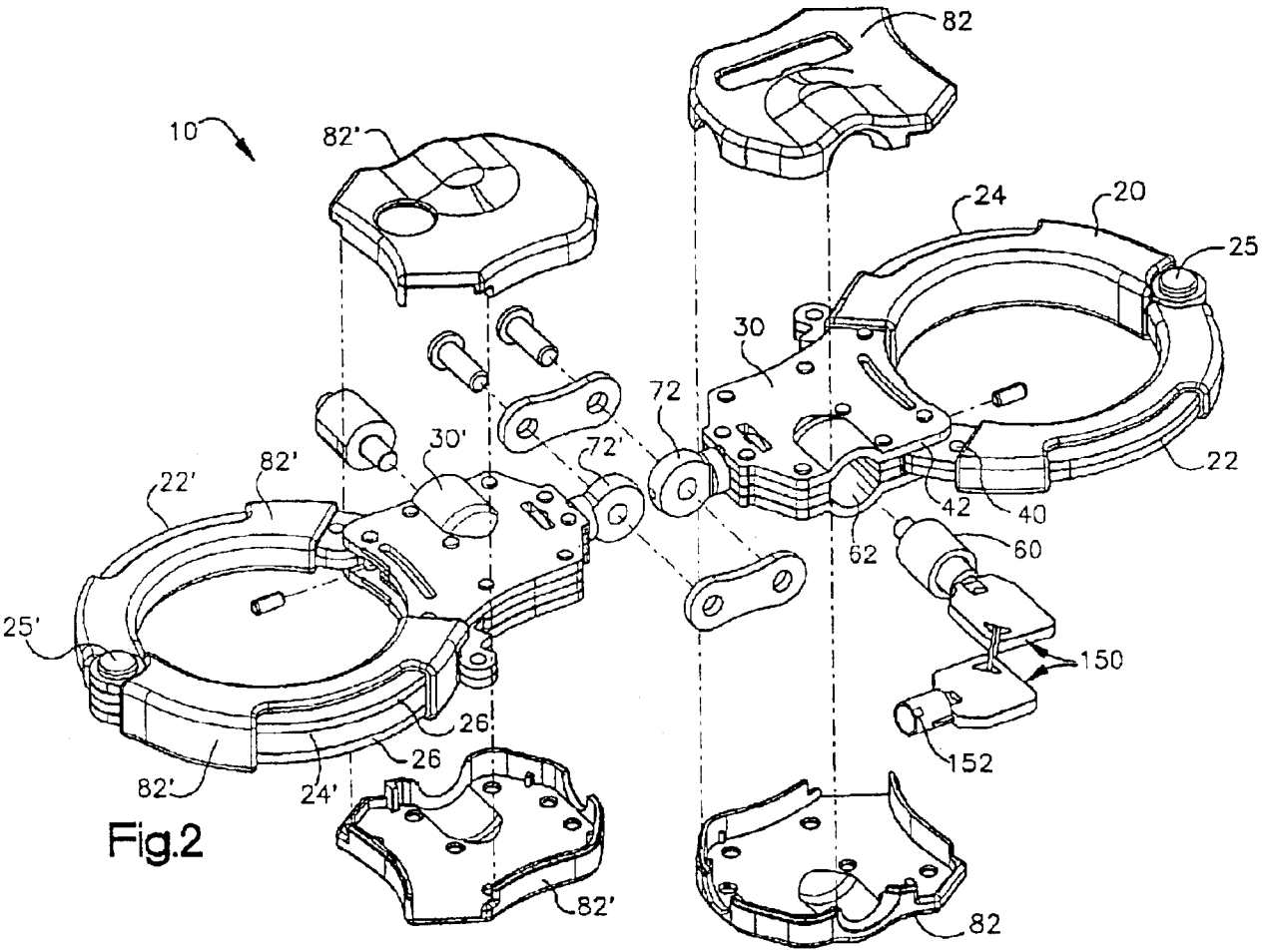
FIG. 2 is a partial exploded front view of the cuff lock shown in FIG. 1 with the protective covering and cylinder lock removed.

The cuff lock as shown generally at 10, is useful for securing articles such as the frame of a bicycle and front tire to a fixture such as a pole. However, the invention is not limited to such use, as there are many other uses readily apparent to those skilled in the art. The cuff lock 10 comprises a first and second cuff 20, 20", and a first and second lock body housing 30,30", wherein the lock bodies are connected together as described in more detail, below.

Each cuff 20,20" comprises a swing arm 22,22" and a stationary arm 24,24" which are pivotally connected together. The swing arm 22 and the stationary arm 24 preferably are curved, and when joined together and in cooperation with the lock body housing form a circular hole 23. The stationary arm is preferably comprised of two or more metal stampings 26 mechanically fastened together. The metal stampings 26 may optionally include the stationary arm 24 and the lock body housing 30 formed as a integral piece. The stationary arm 24 has a first end 28 having aligned holes 29 for receiving the first holed end 32 of the swing arm. A rivet or pin 25,25" is received in the aligned holes 29,32 of the stationary arm 24 and the swing arm 22 for pivotally joining them together.

The swing arm 22 is preferably comprised of two or more layers of metal stampings which are mechanically joined together. The first end 32 of the swing arm is curved and pivotally joined to the stationary arm. A second end 34 of the swing arm 22 further comprises a distal end 36 having a plurality of notches 38 for engagement with a spring loaded lever 50 located within the lock body housing 30. The plurality of notches 38 provide for adjustability of the cuff locks. The distal end 36 of the swing arm 22 is aligned for reception into a transverse bore 39 of the lock body housing 30 for engagement with the locking lever 50. The distal end 36 of the swing arm further comprises an optional positive stop 40 which engages an outer edge 42 of the lock body housing 30 in order to prevent overtightening of the cuff when the distal end of the swing arm is inserted into the transverse bore 39.

Figure 3:
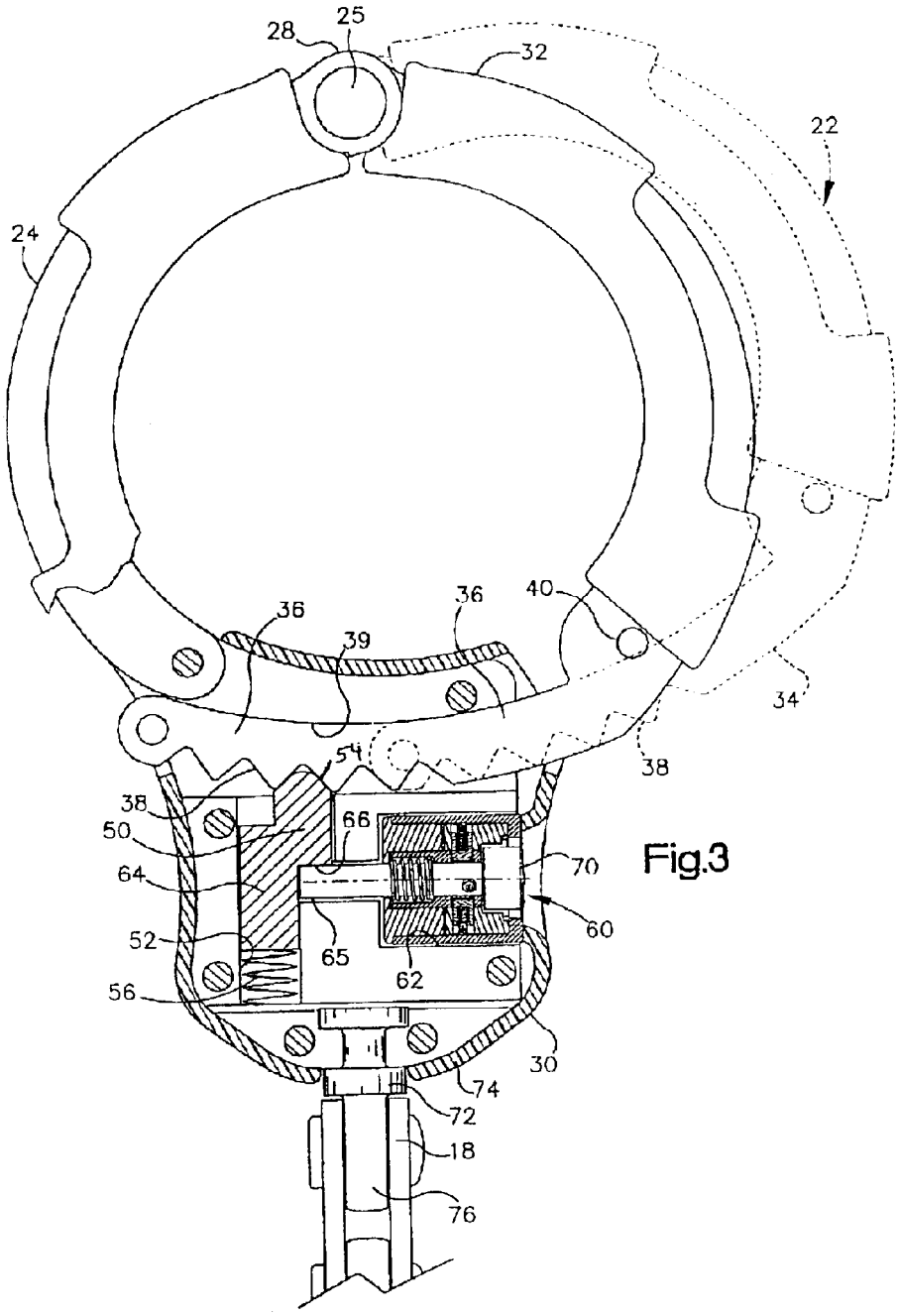
FIG. 3 is a front section view of a portion of the cuff lock as shown in FIG. 1.
Figure 4:
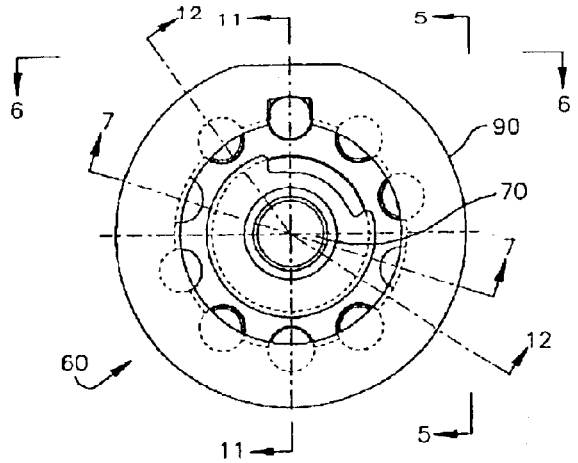
FIG. 4 is a top view of a push button cylinder lock of the present invention.
Figure 5:
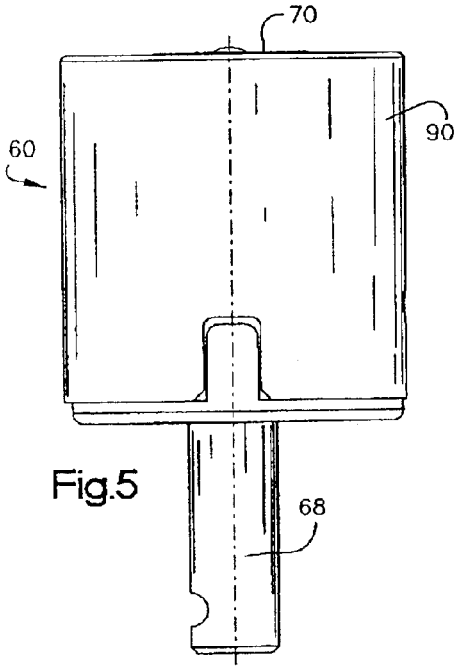
FIG. 5 is a side view in the direction 5—5 of FIG. 4 of the push button cylinder lock.
Figure 6:
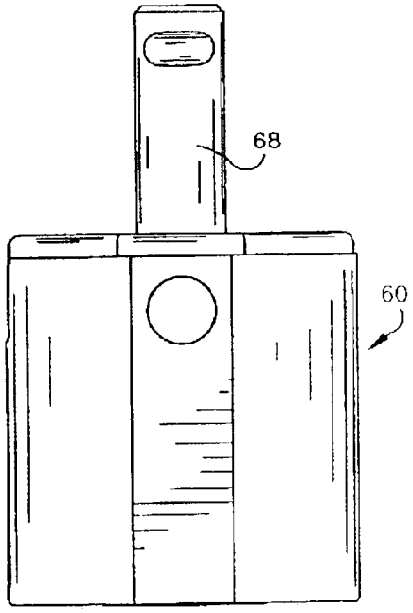
FIG. 6 is a side view in the direction 6—6 of FIG. 4 of the push button cylinder lock.
Figure 7:
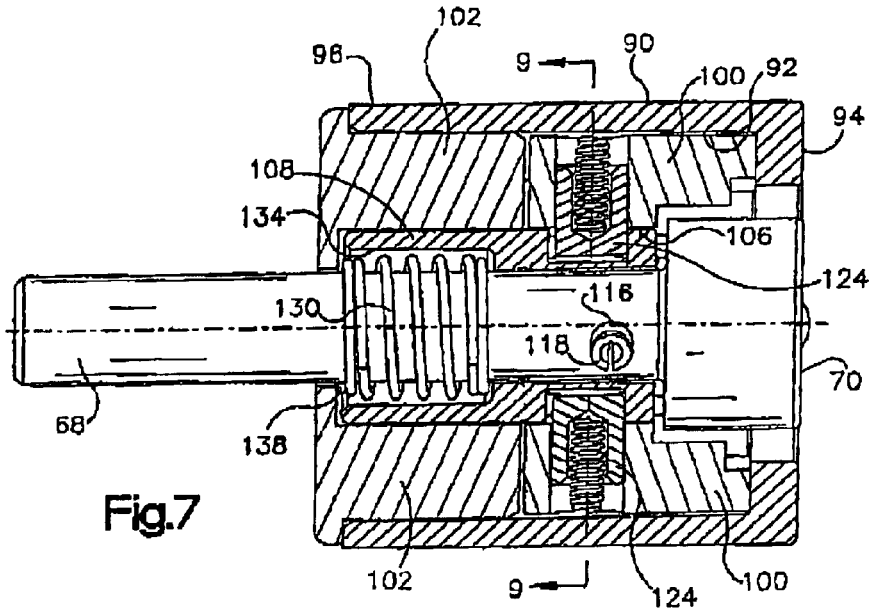
FIG. 7 is a cross-sectional view in the direction 7—7 of FIG. 4 of the push button cylinder lock in the locked position and showing the opposed retaining pins in engagement with the locking indents of the push button actuator.
Figure 8:
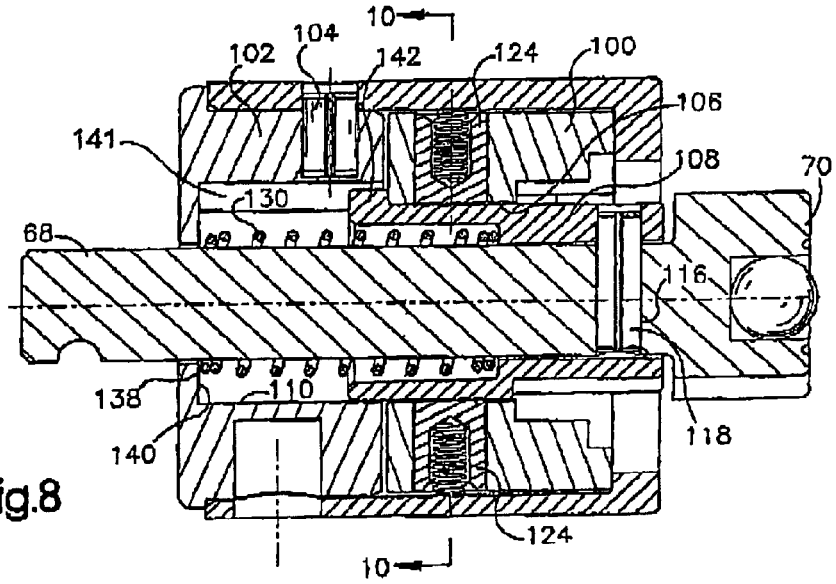
FIG. 8 is a cross-sectional view of FIG. 4 of the push button cylinder lock in the unlocked position and showing the push button shaft in cross-section.
Figure 9:
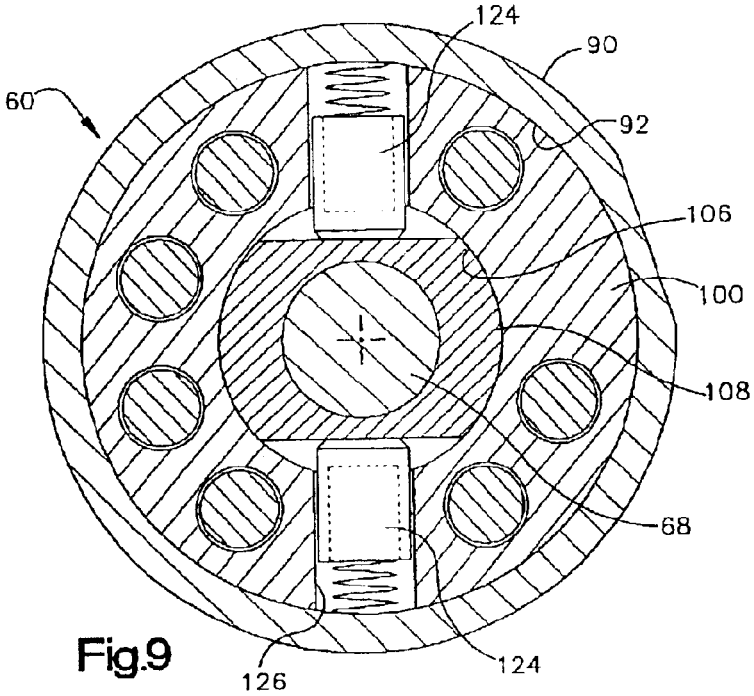
FIG. 9 is a cross-sectional view of FIG. 7 of the push button cylinder lock in the locked position and showing the opposed retaining pins in engagement with the locking indents of the push button actuator.
Figure 10:
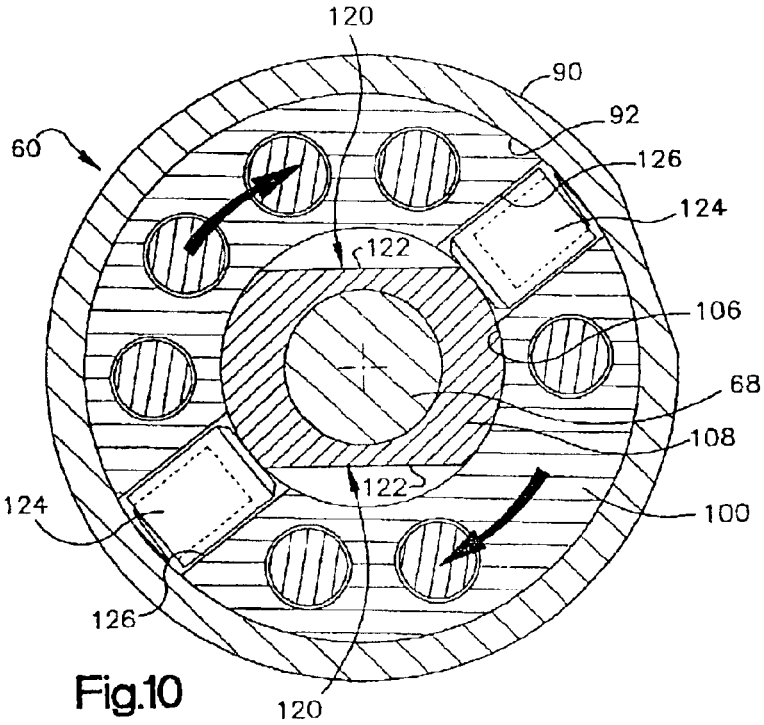
FIG. 10 is a cross-sectional view of FIG. 8 of the push button cylinder lock in the unlocked position and showing the opposed retaining pins being rotated out of engagement with the locking indents of the push button actuator.

The lock body housing 30 further comprises an internal bore 52 which houses the locking lever 50 as best shown in FIG. 3. The locking lever 50 is mounted within the bore 52 and its pointed end 54 is outwardly biased by spring 56 for positive mechanical engagement with the notched or ratcheted end 36 of the swing arm 22. Thus the spring mounted locking lever 50 provides a detent-type action capable of multiple locking positions but which is not secured until the user operates the locking mechanism in order to secure the locking lever. Any type of locking cylinder may be used with the invention, but it is preferred that a push button cylinder be utilized. It is even more preferred that the push button cylinder 60 as described in more detail below be utilized. A push button type cylinder lock allows the user to open, close and adjust each cuff for installation purposes without the need for a key as required by conventional locks. Further, a key is not required to lock each cuff, as the user only need actuate the push button mechanism of the lock. Finally, once the push button lock is actuated into a locked position, the push button shaft is deadlocked and cannot be shimmed.

The lock body housing 30 thus further comprises a bore 62 for receiving a push button cylinder or other looking mechanism. The push button cylinder 60 is mourned perpendicular to the looking lever 50. The locking lever preferably comprises a Z shaped profile, and further includes a mid-section 64 having a shoulder 66 which is positioned for engagement with a shaft 68 of the locking cylinder. When the push button cylinder is actuated into a locked position by pressing the push button outer end 70, the distal end 65 of the push button shaft engages the shoulder 66 of the locking lever deadlocking the locking lever 50 into a locked or secured position.

The lock cylinder may also comprise a rotational type lock cylinder in which the shaft of the lock rotates from a first unlocked position to a second locked position (not shown). The shaft may include an extension which is positioned to engage the shoulder of the locking lever 50 in the locked position, and which may be rotated out of engagement with the shoulder into the unlocked position.

Figure 13:
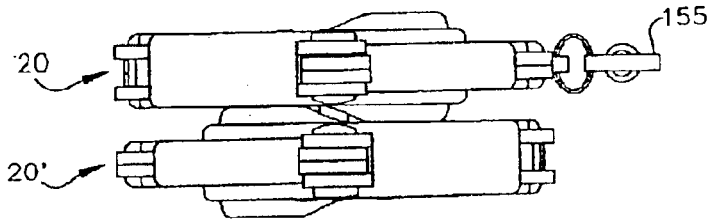
FIG. 13 is a side view of the cuff locks shown in FIG. 1 in the folded position.
Figure 14:
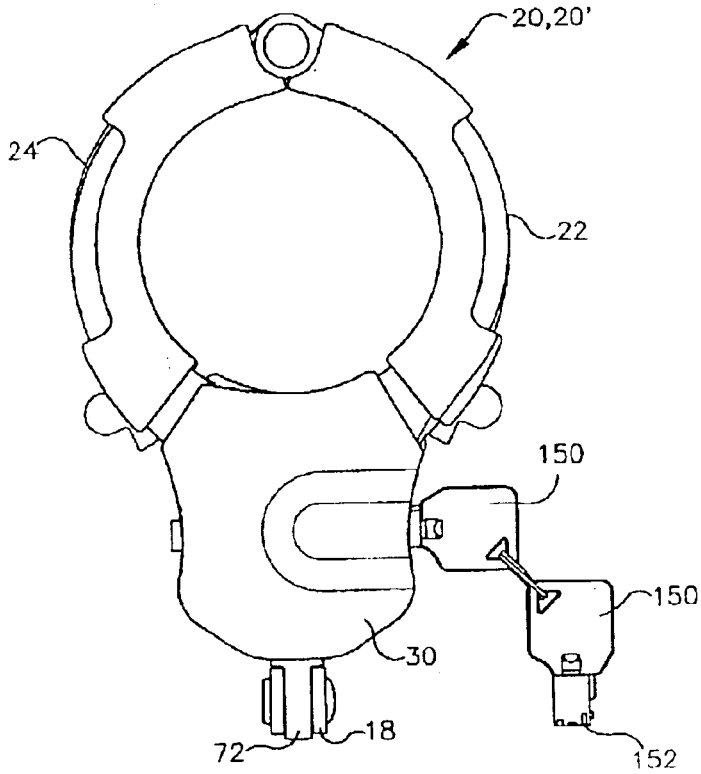
FIG. 14 is a top view of the folded cuff locks of FIG. 13.

Each of the lock body housings 30 may further provide for a swivel 72 rotatably mounted on an end 74 of the lock body housing 30. The swivel 72 allows each cuff to rotate 360 degrees. The swivel 72 further comprises a flanged end 76 which protrudes from the end 74 of the lock body housing and includes a hole 78 for being connected together by a linkage 80. The linkage 80 allows the cuffs to be folded together into a compact position as shown in FIGS. 13 and 14 (i.e., up to 180 degree relative rotation).

The lock body housings 30,30", the swing arms 22,22" and the stationary arms 24,24" of the cuff 20,20" may further comprise a vinyl, plastic or other protective coating 82 in order to prevent scratching of the articles to be locked.

Referring now to FIGS. 4–12, a push button cylinder lock 60 of the present invention is provided. The push button cylinder lock 60 may be used alone or in combination with the bike lock as described above, but is not limited to such use, as there are many other applications. The push button cylinder lock 60 comprises an outer shell housing 90 including an inner axial bore 92 having a first end 94 for receiving a rotatable plug 100 and a second end 96 for receiving a fixed plug 102. The outer shell housing 90, the rotatable plug 100 and the fixed plug 102 are all preferably cylindrical in shape. The rotatable plug 100 and the fixed plug 102 are mounted coaxial with respect to each other. The fixed plug 102 is secured to the outer shell housing via a pin 104. The rotatable plug 100 is rotably mounted within the outer shell housing 90 and has an axial hole 106 for receiving a push button actuator 108 slidably mounted therein. The fixed plug 102 also has an inner hole 110 aligned with the axial hole 106 of the rotatable plug for receiving the push button actuator 108.

The push button actuator 108 further comprises an axial bore 112 for receiving a push button shaft 68 mounted therein. A first end 114 of the push button shaft has a push button flange, and a mid-section of the push button shaft has a transverse hole 116 for receiving a spring-loaded retainer pin 118 therein. The spring loaded retainer pin 118 secures the push button shaft 68 to the push button actuator 108. The push button actuator 108 further includes a mid-section having one or more locking grooves 120. A flat 122 of the locking groove 120 is engaged by a spring mounted retaining pin 124 when the push button is actuated into the locking position. Preferably, two or more retaining pins 124 engage corresponding locking grooves 122. It is preferred that the retaining pins 124 and the corresponding locking grooves be spaced in the range of about 90 to about 180 degrees apart, and more preferably in the range of about 144 to about 180 degrees apart. The spring mounted retaining pins are mounted in radial holes 126 located in the rotatable plug 100, and function to resist axial rotation of the push button actuator 108. Since the spring mounted retaining pins 124 are mounted in a somewhat opposed fashion as described above, they also function to increase the lock's rap resistance or resistance to inertial attack. Thus if the lock is struck hard by an object, one of the retaining pins 124 may be driven out of its locking groove, while the opposed pin may be driven into its locking groove defeating the inertial attack. When the rotatable plug 100 is rotated in order to unlock the lock, the retaining pins 124 are rotated out of the flats 120 of the opposed locking grooves thereby releasing the push button actuator 108 and allowing it to move axially to the unlocked position due to spring action.

The push button actuator 108 further comprises a spring 130 for biasing the push button shaft 68 into the unlocked position. A first end 132 of spring 130 is received in a bore 134 of the second end 136 of the push button actuator 108, and a second end 138 of the spring 130 engages an inner wall 140 of the inner hole of the fixed plug 102. The second end 136 of the push button actuator 108 further comprises an alignment foot 142 which is received in an axial groove 141 of the inner hole of the fixed plug, thereby preventing rotation of the push button actuator 108 and push button shaft 68. Thus as the push button shaft 68 and the push button actuator 108 do not rotate, any cross-sectional shape would work for these components. Another advantage to the non-rotating feature of the push button shaft 68 is that it provides a stable orientation of the projecting shaft.

Figure 12:
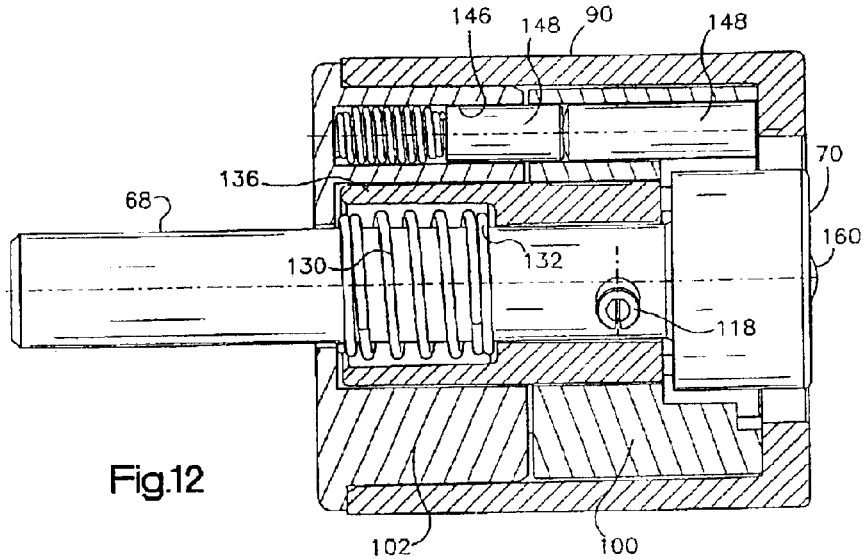
FIG. 12 is a cross-sectional view in the direction 12—12 of FIG. 4 of the push button cylinder lock shown in the locked position and showing the tumbler pins and axial bores in the rotatable plug and the fixed plug.

As shown in FIG. 12, the rotatable plug 100 further comprises a plurality of axially aligned bores 144 aligned with a respective plurality of bores 146 of the fixed plug 102. Two or more spring mounted tumbler pins 148 are received in the bores 144,146 of the rotatable plug and the fixed plug. The bores 144,146 are preferably spaced about a circular pattern in equal increments. It is preferred that the bores 144,146 be spaced on a 10 pin or 36 degree spacing format. When the proper key 150 is inserted into the push button cylinder lock 60, the notches 152 of the key bias the plug pins 148 to the proper height to produce a shear line at the interface of the rotatable plug 100 and the fixed plug 102 thereby permitting rotation of the rotatable plug and the unlocking of the lock.

Figure 11:
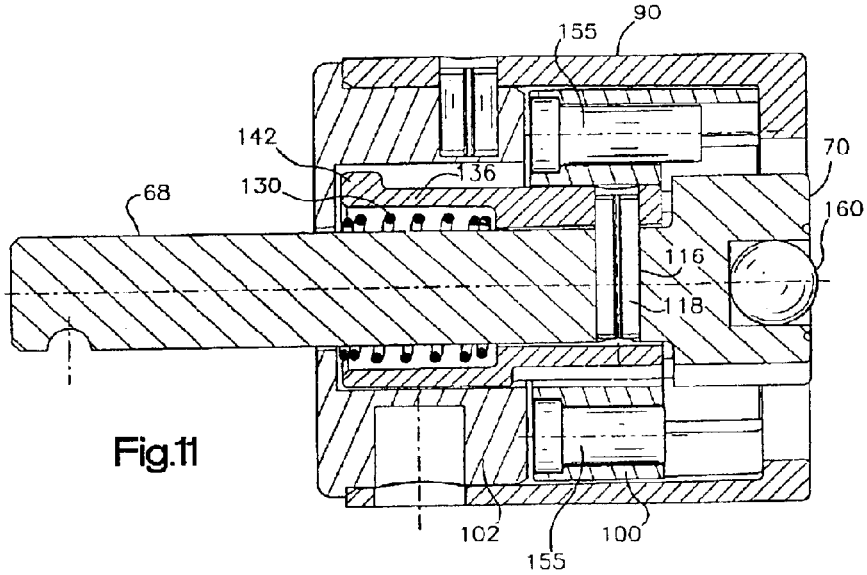
FIG. 11 is a cross-sectional view in the direction 11—11 of FIG. 4 of the push button cylinder lock in the locked position and showing the anti-saw pins in the rotatable plug.

In order to ward off attacks by saws such as trepan tools or hole-saws, it is additionally preferred that the rotatable plug 100 further comprise one or more anti-saw pins 155 mounted in axial bores as shown in FIG. 11, preferably in the "0" and the "5" hole locations. It is additionally preferred that the one or more anti-saw pins 155 comprise different heights and be made of hardened steel. It is further preferred that the head 70 of the push button shaft 68 further comprise a ball bearing 160 mounted in the exposed face of the push button shaft. The ball bearing makes it much more difficult to drill down the center of the push button shaft, as the spherical surface makes it difficult to start a drill.

In order to lock the push button lock assembly, the ball-bearing end of the push button shaft is pushed by a user, pressing it axially until the retaining elements in the rotatable plug engage the slots in the push button actuator, thereby axially securing the shaft. The pin tumbler assembly located in the rotatable and fixed plugs is also in the secured position, as the key has been removed causing the tumbler pins to misalign about the shear line and prevent rotation of the rotatable cylinder. The latching end of the push button cylinder protrudes from the cylinder and is deadlocked into position against the locking lever 64 or other mechanism.

In order to unlock the push button lock assembly, a proper key is inserted aligning the tumbler pin ends to the shear line existing between the fixed plug and rotatable plug. The rotatable cylinder can now be rotated by the key. As the rotatable cylinder rotates, it disengages the retaining elements from the flats of the locking detects causing them to cam out of the flats. As the retaining elements disengage, the spring acting on the push button shaft biases the push button shaft inward so that the latching end of the push button shaft retracts thereby unlocking an independent mechanism such as the locking lever. The key may then be rotated buck to its original position and removed. The lock assembly is now ready to be locked again. Due to the engagement of the alignment foot 142 of the push button actuator 108 with the axial groove 141 of the fixed plug 102, the actuator 108 does not rotate during either the locking or unlocking of the push button cylinder lock 60. As the push button shaft 68 is secured to the actuator by retainer pin 118, the push button shaft 68 also dose not rotate during either the locking or unlocking of the push button cylinder lock 60. Consequently, both the actuator 108 and the push button shaft 68 are only able to slide axially within the push button cylinder lock 60, as they are permanently prohibited from rotating relative to any other portion of the push button cylinder lock 60.

While the preferred embodiments of the invention have been illustrated and described, it should be understood that variations will become apparent to those skilled in the art. Accordingly, the invention is not to be limited to the specific embodiments illustrated and described herein, but rather the true scope and spirit of the invention are to be determined by reference to the appended claims.

What is claimed is:

1. A cylinder lock comprising:

a housing having a rotatable plug rotatably disposed therein and a fixed plug secured to said housing;

a non-rotatable shaft slidably mounted within the housing and slidable between a locked position and an unlocked position, and having an actuated end extending from an end of said housing and a latching end extending from an opposite end of said housing; and one or more retaining elements positioned for engagement with said non-rotatable shaft.

2. The cylinder lock of claim 1 further comprising one or more tumbler pins received in one or more axially aligned bores of said fixed plug and said rotatable plug.

3. The cylinder lock of claim 1 wherein said one or more retaining elements are mounted within radial bores of said rotatable plug.

4. The cylinder lock of claim 1 wherein the cylinder lock comprises two or more retaining elements mounted in the range of about 144 to about 180 degrees apart.

5. The cylinder lock of claim 1 wherein a spring biases said shaft into an unlocked position.

6. The cylinder lock of claim 1 further comprising an actuator fixedly connected to said shaft; said actuator further comprising a foot aligned for reception in an axial groove of said fixed plug whereby rotation of said shaft and actuator is prevented.

7. The cylinder lock of claim 1 wherein said one or more retaining elements are received within a groove of said shaft when said shaft is actuated.

8. The cylinder lock of claim 1 wherein the rotatable plug further comprises one or more anti-saw pins.

9. The cylinder lock of claim 1 wherein an actuating end of the shaft further comprises a ball bearing.

10. A cylinder lock comprising:

a housing having a rotatable plug rotatably disposed therein and a fixed plug secured to said housing;

a non-rotatable shaft slidably mounted within the housing and slidable between a locked position and an unlocked position, and having an actuated end extending from an end of said housing and a latching end extending from an opposite end of said housing; and one or more retaining elements positioned for engagement with one or more aligned grooves of said non-rotatable shaft, wherein rotation of the rotatable plug disengages the retaining elements from said one or more grooves.

11. The cylinder lock of claim 10 wherein a spring biases said shaft into an unlocked position.

12. The cylinder lock of claim 10 further comprising an actuator fixedly connected to said shaft; said actuator further comprising a foot aligned for reception in an axial groove of said fixed plug whereby rotation of said shaft and actuator is prevented.

13. The cylinder lock of claim 10 wherein said one or more retaining elements are received within a groove of said shaft when said shaft is actuated.

14. The cylinder lock of claim 10 wherein said one or more retaining elements are mounted within radial bores of said rotatable plug.

15. The cylinder lock of claim 10 wherein the rotatable plug further comprises one or more anti-saw pins.

16. The cylinder lock of claim 10 wherein an actuating end of the shaft further comprises a ball bearing.

17. The cylinder lock of claim 10 wherein the cylinder lock comprises two or more retaining elements mounted in the range of about 90 to about 180 degrees apart.

18. A cylinder lock comprising:

a housing having a rotatable plug rotatably disposed therein and a fixed plug secured to said housing;

a non-rotatable shaft slidably mounted within the housing and slidable between a locked position and an unlocked position, and having an actuated end extending from an end of said housing and a latching end extending from an opposite end of said housing, wherein a spring biases said non-rotatable shaft into an unlocked position.

19. A cylinder lock comprising:

a housing having a rotatable plug rotatably disposed therein and a fixed plug secured to said housing;

a non-rotatable shaft slidably mounted within the housing and slidable between a locked position and an unlocked position, and having an actuated end extending from an end of said housing and a latching end extending from an opposite end of said housing, and an actuator fixedly connected to said shaft; said actuator further comprising a foot aligned for reception in an axial groove of said fixed plug whereby rotation of said shaft and actuator is prevented.

* * * * *